United States Patent [19]

Hayden

[11] 4,301,654

[45] Nov. 24, 1981

[54] PRESSURIZED FLUID MOTOR

[76] Inventor: David W. Hayden, 1225 Martha Custis Dr., Alexandria, Va. 22302

[21] Appl. No.: 91,785

[22] Filed: Nov. 6, 1979

[51] Int. Cl.[3] ..... F01K 25/06

[52] U.S. Cl. ..... 60/649; 60/673

[58] Field of Search ..... 60/649, 673, 370, 671, 60/651, 650, 682, 516

[56] References Cited

U.S. PATENT DOCUMENTS 4,006,595 2/1977 Forbes ..... 60/516 X

FOREIGN PATENT DOCUMENTS 368439 11/1906 France ..... 60/682
13764 of 1851 United Kingdom ..... 60/673
10735 of 1899 United Kingdom ..... 60/671

*Primary Examiner*—Allen M. Ostrager
*Assistant Examiner*—Stephen F. Husar
*Attorney, Agent, or Firm*—Wells & Wells

[57] ABSTRACT

The principle of the acid/soda fire extinguisher is applied to generating pressure in the expansible chamber of a power plant or engine.

Pressure is generated in a first container by adding sulfuric acid to a bicarbonate of soda solution and the pressurized solution is applied alternatively to the two sides of a double acting piston. The unpressurized side of the piston is alternatively connected to a second container for the collection of used solution.

When the solution in the first container is used up, the solution in the second container is activated by the addition of more sulfuric acid and the cycle is reversed.

7 Claims, 2 Drawing Figures

PRESSURIZED FLUID MOTOR

BACKGROUND OF THE INVENTION

The present invention relates to power plants and the invention is particularly concerned with a special motive fluid used within an expansible chamber.

According to the present invention, the principle of the sulfuric acid/bicarbonate of soda fire extinguisher is used to generate pressure for use in an expansible chamber of a power plant or engine.

It is known in the fire protection art to put out fires with an acid/soda extinguisher. This extinguisher has a closed chamber containing a solution of bicarbonate of soda. At the top of the extinguisher, above the soda solution, is an open top cup containing sulfuric acid. When the extinguisher is inverted the sulfuric acid is mixed with the bicarbonate of soda solution and carbon dioxide is released with an increase in pressure in the closed container. The force of the carbon dioxide released drives the water solution mixed with carbon dioxide through a hose and nozzle for extinguishing fires.

As established by a preliminary search, no prior art could be found wherein the above principle is used to operate a power plant or engine with an expansible chamber.

SUMMARY OF THE INVENTION

It is an object of the present invention to provide a power plant which does not release harmful and toxic gases to the atmosphere.

Another object of the present invention is a power plant which does not use organic fuels.

Still another object of the present invention is a power plant where the fluid used is collected in a reservoir and recycled without exposure to the atmosphere.

According to the present invention, pressure is generated in a first reservoir or container by adding sulfuric acid to a bicarbonate of soda solution. The pressurized solution is applied alternatively to the two sides of a double acting piston while the unpressurized side of the piston is alternatively connected to a second reservoir for the collection of used solution.

When the solution in the first reservoir is used up the solution in the second reservoir is activated by the addition of more sulfuric acid and the cycle is reversed with pressure coming from the second reservoir and the wasted solution being collected in the first reservoir.

BRIEF DESCRIPTION OF THE DRAWINGS

The present invention may best be explained by reference to the attached drawings which show one embodiment thereof, wherein.

DESCRIPTION OF THE PREFERRED EMBODIMENT

Figure 1:
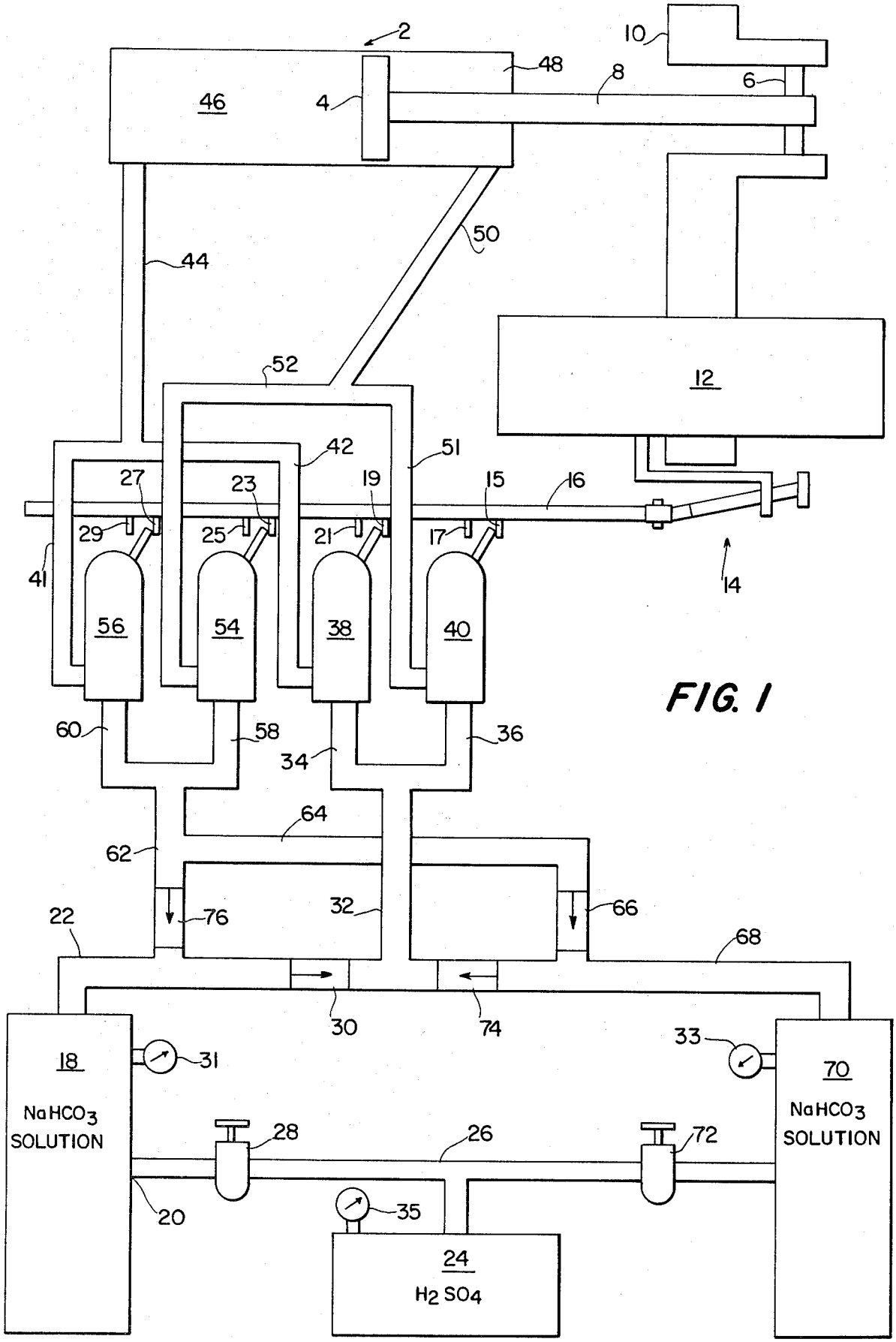
FIG. 1 is a top plan view showing the apparatus of the present invention.

With particular reference to FIG. 1, the double acting piston designated generally as 2 has a piston 4 connected to a single throw crank 6 by a piston rod 8. The crank 6 is mounted on crank-shaft 10 and flywheel 12 is also mounted thereon.

Figure 2:
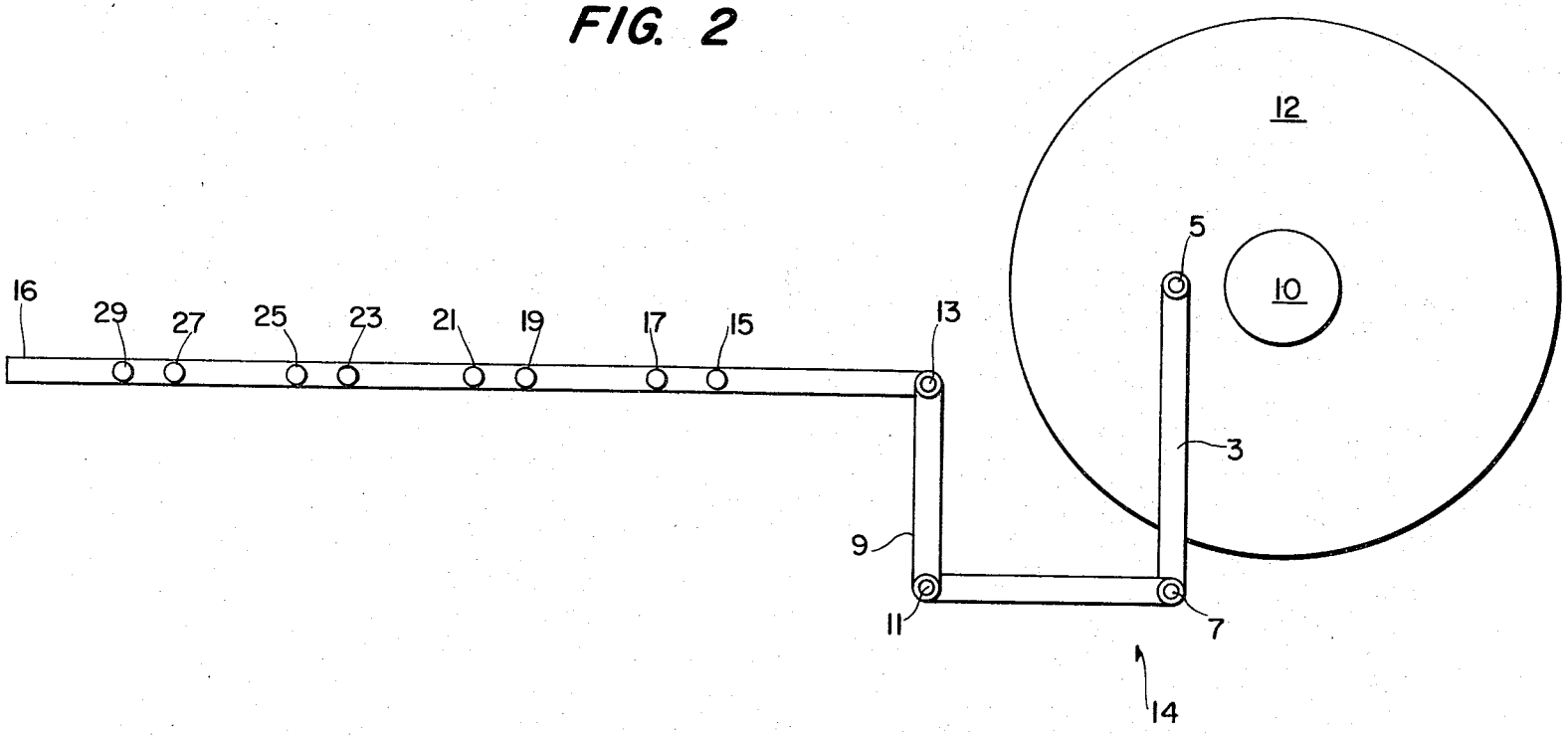
FIG. 2 is a detailed side view of the flywheel and valve gear control of the present invention.

Valve gearing designated generally as 14 and shown in detail in FIG. 2 controls adjustable tappits 15,17,19,21,23,25,27 and 29 which are mounted on valve control rod 16.

Container 18 having an inlet 20 and an outlet line 22 is first filled with a solution of sodium bicarbonate ($NaHC0_3$). Sulfuric acid from container 24 is introduced into container 18 by conduit 26 and cutoff valve 28.

The sulfuric acid introduced into container 18 reacts with the bicarbonate of soda and generates carbon dioxide which causes a pressure build up in container 18 as indicated on pressure gauge 31. A solution of water, carbon dioxide and bicarbonate solution then proceeds out of outlet line 22 past check valve 30 and into line 32 which branches into lines 34 and 36. At this point, valve 40 controlled by tappets 15 and 17 is open and valve 38 controlled by tappets 19 and 21 is closed so that the solution under pressure is directed into lines 51 and 50 into chamber 38 of piston 2.

At the same time pressurized solution enters chamber 48, spent solution is evacuated from chamber 46 by way of lines 44 and 41 into valve 56, held open by tappits 27 and 29 while valve 54 is actuated closed by tappets 23 and 25.

The spent fluid passes through valve 56 into lines 60,62 and 64 and past check valve 66 into line 68 and container 70 having pressure gauge 33.

As the piston 4 proceeds to the left and into chamber 44, the camshaft 10 rotates flywheel 12 and valves 40 and 56 are closed as valves 38 and 54 are opened.

Pressurized fluid now proceeds through lines 32 and 34 through valve 38 into lines 42 and 44 into chamber 46 to apply pressure to the left side of piston 4.

As the left side of piston 4 is pressurized, spent fluid leaves chamber 48 through lines 50 and 52 into open valve 54 and from there into lines 58, 62 and 64 through check valve 66 into line 68 and container 70.

When the solution in container 18 is spent as indicated by a decrease in the internal pressure of the container by gauge 31, another portion of sulfuric acid from container 24 is added to container 70 by way of line 26 and valve 72. The sulfuric acid held in container 24 is ejected by means of air pressure as indicated by pressure gauge 35.

After the addition of sulfuric acid to the bicarbonate solution of container 70, pressure is again generated and the solution indicated as under pressure by gauge 33 passes into line 68 through check valve 74 and into lines 32,36 and into valve 40 whereby chamber 48 is again pressurized and chamber 46 is evacuated of spent solution.

The spent solution from chamber 46 proceeds through lines 44 and 41, valve 56, lines 60 and 62 through check valve 76 and from there to chamber 18 by way of line 22.

The second stroke pressurized by chamber 70 then proceeds as it did in the second stroke from chamber 18.

The valve gear 14 is shown in FIG. 2 where flywheel 12 mounted on camshaft 10 actuates the gearing. Rod 3 having articulators 5 and 7 rocks L-shaped arm 9 having a pivot at 11 and an articulation at 13.

The rocking of arm 9 moves valve rod 16 back and forth so that tappets (15,17), (19,21), (23,25) and (27,29) open and close valves 40, 38, 54 and 56, respectively.

Best Mode of Carrying Out the Invention

The present invention as now embodied has the following engine specifications:

| | |
|---|---|
| Maximum horsepower | 2.9 |
| Maximum pressure generated | 80 lbs/in$^2$ |
| Area of piston | 1.25 in$^2$ |
| Area of Piston (rod side) | 0.75 in$^2$ |
| Approximate RPM | 64 |
| Length of stroke | 2.5 in x 2 |

1 stroke=5 fluid oz

Maximum output=320 fluid oz/min at 80 psi

The containers 18, 24 and 70 are modified stainless steel acid/soda fire extinguishers and the bicarbonate of soda and sulfuric acid was purchased from George D. Feidt & Co., Glenside, Pennsylvania. The concentration of bicarbonate of soda used was 1½ lbs of bicarbonate of soda in 2½ gallons of water. For generation of pressure, 4 fluid ounces of sulfuric acid were added to the bicarbonate of soda solution.

Air pressure is applied to container 24 so that sulfuric acid can be ejected by way of an air pump.

I claim:

1. A method of generating pressure in the expansible chamber of a power plant, comprising:

(a) adding sulfuric acid to a solution of bicarbonate of soda in a first container and generating a solution under pressure;

(b) conducting said solution under pressure through first valving means to a first side of a double acting piston;

(c) evacuating spent solution by a second side of said double acting piston through second valving means and conducting said spent solution to a second container;

(d) reversing said first and second valving means and conducting said solution under pressure through third valving means to said second side of said double acting piston;

(e) evacuating additional spent solution by said first side of said double acting piston through fourth valving means and conducting said additional spent solution to said second container; and (f) adding additional sulfuric acid to said spent solution in said container and directing solution under pressure generated therein to said double acting piston through a check valve means.

2. An apparatus for generating pressure in an expansible chamber of a power plant comprising:

(a) a first container having a first inlet and a first outlet for containing a solution of bicarbonate of soda;

(b) control means for delivering sulfuric acid to said first container and generating a solution under pressure in said first container;

(c) said expansible chamber having a double acting piston with a first side and a second side;

(d) a second container having a second inlet and a second outlet for containing spent bicarbonate of soda solution;

(e) first valving means for delivering solution under pressure from said first container to said first side of said double acting piston;

(f) second valving means for evacuating spent solution from said second side of said double acting piston and conducting said spent solution to said second inlet of said second container;

(g) third valving means for delivering solution under pressure from said first container to said second side of said double acting piston;

(h) fourth valving means for evacuating additional spent solution from said first side of said double acting piston and conducting said additional spent solution to said second inlet of said second container; and (i) means for reversing said first, second, third and fourth valving means.

3. The apparatus of claim 2, wherein said control means of (b) is connected to said second inlet for delivering sulfuric acid to said second container and reversing the cycle of said apparatus.

4. The apparatus of claim 2, wherein said means for reversing said first and third valving means and delivering solution under pressure alternatively to said first side and then said second side comprise:

(j) a piston rod with one end connected to said piston;

(k) a single throw bearing mounted on a camshaft connected to the other end of said piston rod;

(l) a flywheel on said camshaft;

(m) valve gearing having a valve rod actuated by said flywheel; and (n) a plurality of pressure line valves connected between said first outlet and said double acting piston and actuated alternatively by said valve rod.

5. The apparatus of claim 4, wherein said means for reversing said second and fourth valving means and delivering spent solution alternatively comprise:

(o) a plurality of return line valves connected between said second outlet and said double acting piston and actuated alternatively by said valve rod.

6. The apparatus of claim 5 having a plurality of check valves located between said containers and said valves.

7. The apparatus of claim 6, wherein said control means is a third container having a third outlet with sulfuric acid under pressure therein and a plurality of hand operated valves connected between said third outlet and said first and second inlets.

* * * * *